United States Patent [19]

Fletcher et al.

[11] 4,008,407

[45] Feb. 15, 1977

[54] NUCLEAR THERMIONIC CONVERTER

[76] Inventors: James C. Fletcher, Administrator of the National Aeronautics and Space Administration, with respect to an invention by; Wayne M. Phillips, La Crescenta; Jack F. Mondt, La Canada, both of Calif.

[22] Filed: Oct. 3, 1972

[21] Appl. No.: 294,727

[52] U.S. Cl. ..... 310/4 R; 313/311;346 R

[51] Int. Cl.[2] ..... H01J 45/00

[58] Field of Search ..... 310/4; 176/39; 313/311

[56] References Cited

UNITED STATES PATENTS

| | | | |
|---|---|---|---|
| 2,922,028 | 1/1960 | Butler et al. | 313/311 X |
| 3,201,619 | 8/1965 | Gleason et al. | 310/4 |
| 3,287,578 | 11/1966 | Oldekop et al. | 310/4 |
| 3,299,299 | 1/1967 | Dickinson | 310/4 |
| 3,439,193 | 4/1969 | Bensussan | 176/39 X |

*Primary Examiner*—Donovan F. Duggan
*Attorney, Agent, or Firm*—Monte F. Mott; Paul F. McCaul; John R. Manning

[57] ABSTRACT

A thermionic converter unit for use in a nuclear reactor to generate current, which can be constructed at low cost and which efficiently utilizes the nuclear fuel. The reactor utilizes an array of thermionic emitters whose peripheries are fluted so that a bulge of one emitter interfits the depression of another, to permit compact mounting, each emitter having several fuel passages located in the bulged portions for holding nuclear fuel and having a central collector passage for holding a thermionic collector. The emitters are constructed of rods of tungsten containing a small amount of thorium oxide, the thorium oxide not only improving the machinability of the tungsten but making it an efficient emitter.

5 Claims, 3 Drawing Figures

NUCLEAR THERMIONIC CONVERTER

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates to thermionic converters, and especially to thermionic converters utilized in nuclear reactors.

One type of nuclear reactor includes an array of thermionic converter units that contain quantities of nuclear fuel. The nuclear fuel heats the emitters of the units while streams of fluid cool the collectors of the units, to create a temperature difference that results in the generation of current. One type of reactor which is intended for use on extra-terrestrial vehicles utilizes an array of emitter rods constructed of tungsten to permit operation at high temperatures. Passages in the tungsten rods hold pellets of nuclear fuel that heat the rods. Collectors are positioned close to certain emitter surfaces to collect electrons leaving the emitter and thereby create electricity.

One problem encountered, particularly in the case of small reactors, is the efficient utilization of the nuclear fuel. The fuel must be closely packed in order to cause the reactor to go critical with a minimum of fuel. However, space must be provided between the nuclear pellets to hold emitters that are to be heated by the fuel and to provide space for the cooled collectors that are positioned close to the emitters. Generally, many converter units are utilized which are electrically connected in series and which must be spaced from one another to prevent electrical shorting. An arrangement of emitters, collectors, and nuclear fuel which permitted close packing of the fuel while providing for sufficient heating of the emitters by the fuel and efficient cooling of the collectors, all in a structurally sound arrangement, would permit the construction of compact and reliable nuclear reactors.

Considerable attention is given to the construction of the emitters used in the nuclear reactors, inasmuch as these elements generally must withstand the highest temperatures and provide structural strength. Tungsten is often utilized, inasmuch as it has a relatively high vacuum work function and can withstand very high temperatures. The work function of tungsten varies somewhat, in a range such as 4.2 to 5.2 volts, with the work function generally being at the lower end of the range for the relatively pure tungsten that has been often utilized in emitters. The work function has been raised by the vapor deposition of tungsten on the emitter surfaces of the tungsten rods, using first a vapor deposition from tungsten hexafloride to obtain a high strength base layer of tungsten and then using a vapor deposition from tungsten hexachloride to obtain a tungsten layer with a 110 crystalographic orientation which produces a high vacuum work function. However, the vapor deposition process is expensive. The efficiency of operation of the emitter has also been found to improve by the addition of small amounts of oxygen to the emitter surface. This also is an expensive process. A tungsten emitter material which could operate efficiently without requiring vapor depositions of tungsten or the addition of oxygen to the emitter surfaces could be constructed at lower cost.

SUMMARY OF THE INVENTION

In accordance with one embodiment of the present invention, efficient nuclear reactor thermionic converter units are provided which can be constructed at relatively low cost and which can be assembled into a reactor which requires a minimum of nuclear fuel. Each converter unit utilizes an emitter rod with a fluted exterior, several fuel passages located in the bulges that are formed in the rod between the flutes, and a collector-receiving passage formed through the center of the rod. An array of rods are closely packed in an interfitting arrangement, with the bulges of the rods received in the recesses formed between the bulges of other rods, thereby closely packing the nuclear fuel. The rods are constructed of a mixture of tungsten and thorium oxide to provide high power output, high efficiency, high strength and good machinability. The addition of approximately 2 percent by weight of thorium oxide makes the tungsten easy to machine so that the fluted exterior can be formed at low cost. The thorium increases the vacuum work function of the tungsten to the upper portion of its range, so that an expensive vapor deposition of chloride is not necessary. The oxygen contained in the thorium oxide eliminates the need for expensive processing of the emitter surface region of the tungsten rod to add oxygen to it.

The novel features that are considered characteristic of this invention are set forth with particularity in the appended claims. The invention will best be understood from the following description when read in connection with the accompanying drawings.

DESCRIPTION OF THE PREFERRED EMBODIMENTS

Figure 1:
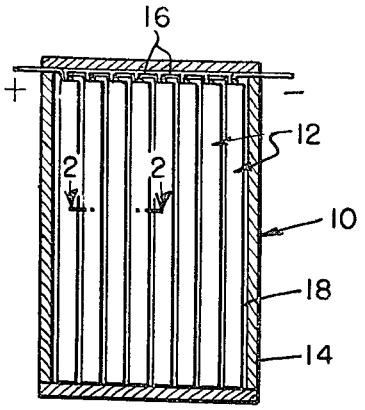
FIG. 1 is a highly simplified view of a nuclear reactor constructed in accordance with the present invention.

FIG. 1 is a highly simplified illustration of an in-core thermionic reactor system which utilizes numerous converter units 12 to generate current. The converter units 12 are mounted in a housing 14 and are connected in series by electrical connectors 16. Each of the units 12 contain an emitter and collector which generate current when the emitter is maintained at a higher temperature than the collector. Each of the units 12 also contains nuclear fuel, and the fuel contained in the numerous units 12 is of sufficient mass and is packed sufficiently close so that the reactor becomes critical and the fuel creates heat. The heat maintains the emitters of the units at a high temperature. Cooling fluid flows through the collectors by way of a manifold system or a heat-pipe system (not shown) to maintain the collectors at a lower temperature than the emitters. The reactor system 10 is of a type which is designed for use in extra-terrestrial vehicles to supply electrical current thereto.

Figure 2:
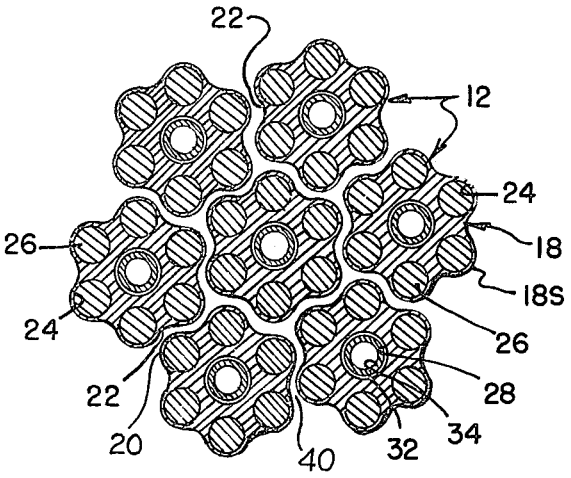
FIG. 2 is a partial view taken on the line 2—2 of FIG. 1.
Figure 3:
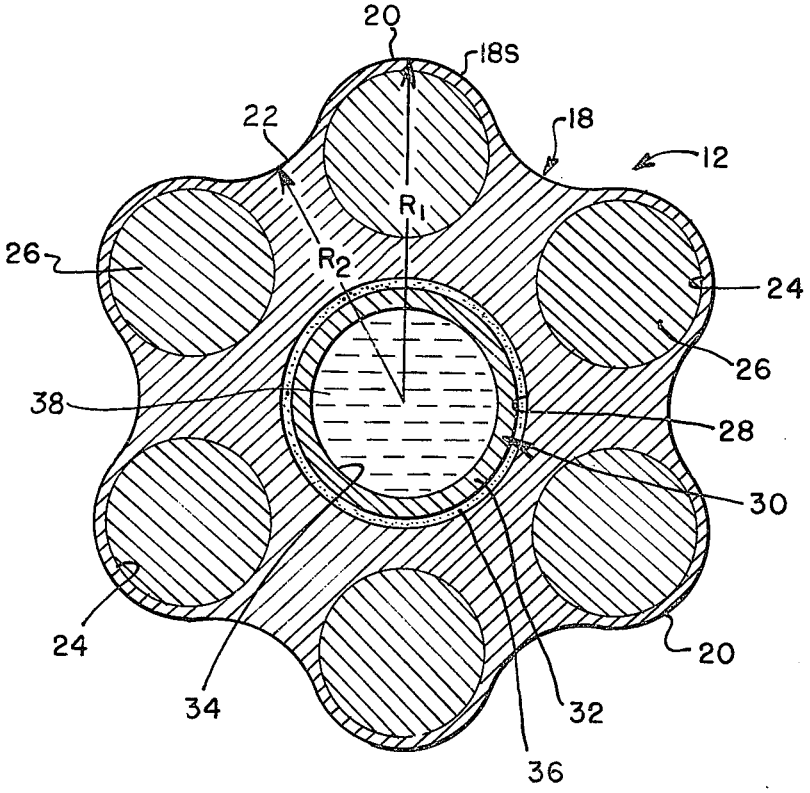
FIG. 3 is an enlarged view of one converter unit of the array of FIG. 2.

Referring also to FIGS. 2 and 3, it can be seen that each of the units 12 includes an emitter 18 in the form of a long rod with a fluted periphery or outer surface 18s. The flutes form six circumferentially spaced bulges 20 where the rod has a maximum radius $R_1$ such as ¾ inch, separated by six flutes or recesses 22 where the periphery of the rod has a minimum radius $R_2$. The emitter rod 18 has six fuel passages 24 extending parallel to its length, each fuel passage substantially centered on an imaginary maximum radial line $R_1$, or in other words, each fuel passage being located within a bulged portion of the rod. Pellets 26 of a nuclear fuel, such as enriched uranium oxide, are disposed in the fuel passages 24. The emitter rod 18 also has a central or collector passage 28 extending parallel to its length. A collector 30 is located within the collector passage 28. The collector 30 includes a tube 32 of a material such as niobium or molybdenum, with a large central passage 34 containing a cooling fluid such as sodium, potassium, or a sodium-potassium mixture. The space 36 between the emitter rod 18 and collector tube 32 is filled with cesium which is maintained at a predetermined low pressure.

The nuclear fuel 26 generates heat that maintains the emitter rods 18 at a high temperature such as 1800° C. The cooling fluid 38 maintains the collector 30 at a much lower temperature, such as 700° C. This temperature differential results in the generation of current. Electrons emitted by the emitter surface 28 are captured by the adjacent surface of the collector tube 32, so that the emitter becomes positive and the collector becomes negative. Each unit 12 can generate a high current at a low voltage, and therefore groups of units are normally connected in series. Accordingly, it is necessary to maintain the units separated. The region 40 between the units contains a vacuum.

The amount of nuclear fuel that is required in the reactor in order to make it critical depends upon the separation of the fuel pellets. If the nuclear fuel can be held in a compact arrangement, then a smaller amount of fuel (as well as a smaller number of converter units) will be sufficient and the size and weight of the reactor can be minimized. However, minimization of fuel mass is only one consideration, inasmuch as it is also important to provide effective transfer of heat from the fuel to the emitters, effective cooling of the collectors, and proper positioning of the collectors with respect to the emitters. The construction of the converter units 12 and their close nesting, which is provided by the present invention, makes efficient use of the nuclear fuel in an overall efficient in-core thermionic reactor system.

The several fuel passages 24 in the emitter rod 18 provide a large space for holding nuclear fuel and also provide a large fuel surface area for the transfer of heat from the fuel to the emitter rod. The provision of undulations in the outer surface 18s of the emitter rods permits them to be nested close together without greatly decreasing the strength of the rods. Thus, by holding the units in the manner illustrated in FIG. 2, with the bulge 20 of one emitter rod received in the recess 22 of another rod, the fuel 26 is packed close together. The units 12 are still held with the emitter rods 18 spaced from one another so they are not electrically shorted in a reactor where the different units are electrically connected in series. The arrangement of the fuel passages 24 around the periphery of the emitter rod still leaves a considerable space for the collector passage 28 where the collector 30 is received.

Each emitter rod 18 is constructed primarily of tungsten. Tungsten retains its structural strength at high temperatures, and also has a relatively high vacuum work function, which makes it suitable for use in in-core thermionic reactor systems. The vacuum work function of tungsten ranges from about 4.2 volts to 5.2 volts. Where substantially pure tungsten has been utilized in thermionic converters, the work function generally has been measured to be near the low end of the voltage range. The work function has been found to be raised by vapor depositing tungsten from tungsten hexachloride on the surface area of the tungsten which is to serve as the emitter. However, this is an expensive operation. In the preparation of tungsten emitters, it also has been previously found to be beneficial to add oxygen to the surface portion which is to serve as the emitter. In the absence of oxygen, the current that is produced quickly falls to a low level. It is believed that cesium is required in order to minimize the space charge near the emitter but that it results in losses, and that the presence of oxygen at the surface of the emitter causes the cesium to adhere better to the emitter and results in lower losses. Thus, in the prior art construction of one type of emitter, the emitter was constructed of substantially pure tungsten, and tungsten vapor depositions and oxygen were applied to the emitter surface. The tungsten was difficult to machine and the processes for vapor deposition and oxygen addition involved considerable expense.

In accordance with the present invention, the emitter 18 is constructed of a mixture of tungsten and thorium oxide ($ThO_2$), with the thorium oxide, or thoria, constituting no more than a few percentage by weight of the material. It has been found that the addition of approximately two percent by weight of thoria eliminates the need for the vapor depositions of tungsten or the addition of oxygen to the emitter surface. That is, emitters constructed of tungsten and thoria have been found to have a vacuum work function near the upper end (approximately 5.2 electron volts) of the work function range which can be obtained with tungsten; furthermore, when these emitters have been utilized to generate current by heating them to a high temperature and maintaining a collector close to the emitter surface and with the region between them filled with cesium at low pressure, a high level of current has been stably generated. As has been previously well known, the addition of thoria makes the tungsten more machinable and of higher strength. Thus, the addition of thoria not only makes the emitter rods more economical to fabricate in the first place, but eliminates the need for special coatings to make the rods serve efficiently as thermionic emitters. The increased machinability can be especially valuable where the rods are machined in a relatively complicated shape, as with the flutes of the emitter rods 18. Although the use of approximately 2 percent by weight of thoria produces the best machinability, a smaller percentage of thoria can be employed and the emitter will still function well without the need for vapor depositions or additional oxygen.

Thus, the invention provides an in-core thermionic reactor system which requires a relatively small amount of nuclear fuel and which can be constructed at a relatively low cost. This is accomplished by utilizing emitter rods having peripheries that undulate in radius and which hold nuclear fuel in the bulges formed by the undulations, and by holding the emitter rods with the bulges of the rods received in the recesses of other rods. The emitter rods themselves are constructed at a minimum cost by the addition of thoria to the tungsten emitter. The thoria not only makes the tungsten more machinable, but eliminates the need for applying vapor deposited tungsten and oxygen which has been previously necessary to achieve high efficiency.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. Thermionic reactor apparatus comprising:

a rod having a central passage with the walls thereat of emitting material, and having a plurality of fuel passages located between the central passage and the periphery of the rod, the periphery of said rod undulating in radius and having maximum radii along imaginary radial lines passing through the fuel passages and minimum radii along imaginary radial lines passing between adjacent fuel passages;

nuclear fuel disposed in said fuel passages;

and a collector disposed in said central passage.

2. The apparatus described in claim 1 including:

a plurality of additional rods substantially identical to said first named rod, a plurality of collectors disposed in said additional rods, and nuclear fuel disposed in the fuel passages of said additional rods;

said rods mounted parallel to each other and with a bulge of each rod formed by a peripheral region thereof of maximum radius, received in a recess of another rod formed by a rod peripheral region of minimum radius.

3. The apparatus described in claim 1 wherein:

the peripheral surface and central passage walls of said rod are machined surfaces, and said rod is constructed of a mixture of tungsten and approximately two percent thorium oxide.

4. Current generating apparatus comprising:

a plurality of elongated rods mounted parallel to each other, each rod having an outer surface that undulates in radius to form circumferentially spaced bulges and recesses, and the rods being mounted with the bulges of some rods received in the recesses of other rods, each rod having a plurality of fuel passages extending parallel to the length of the rod and located within the bulged portions thereof, and each rod having a collector passage extending parallel to the length of the rod;

nuclear fuel disposed in said fuel passages;

and a collector disposed in said collector passage.

5. The current generator described in claim 4 wherein:

said rods have machined outer surfaces that are spaced small distances from one another, and each of said rods is constructed of a mixture of tungsten and thorium oxide.

* * * * *